US005359738A

United States Patent [19]

Kurtz

[11] Patent Number: 5,359,738

[45] Date of Patent: Nov. 1, 1994

[54] TOILET TISSUE WETTING DEVICE

[76] Inventor: John G. Kurtz, 102 Hoffman Rd., Rochester, N.Y. 14622

[21] Appl. No.: 232,660

[22] Filed: Apr. 25, 1994

[51] Int. Cl.[5] ..... A47K 17/00

[52] U.S. Cl. ..... 4/661

[58] Field of Search ..... 4/300.1, 661

[56] References Cited

U.S. PATENT DOCUMENTS

| | | | |
|---|---|---|---|
| 3,045,248 | 7/1962 | Gentry | 4/7 |
| 3,083,374 | 4/1963 | Watlington | 4/300.1 X |
| 3,195,148 | 7/1965 | Merkell, Jr. | 4/7 |
| 4,451,943 | 6/1984 | Nibler | 4/300.1 X |
| 4,596,058 | 6/1986 | Nourbakhsh | 4/448 |
| 5,090,067 | 2/1992 | Cogdill | 4/420 |
| 5,101,520 | 4/1992 | Lockhart | 4/447 |
| 5,142,711 | 9/1992 | Parikh | 4/420.4 |

*Primary Examiner*—Charles E. Phillips
*Attorney, Agent, or Firm*—Frank A. Lukasik

[57] ABSTRACT

A device for wetting toilet tissue comprising a small, enclosed reservoir fitted with air vents, a finger actuated valve lever, an inlet and outlet orifice and a water flow controlling valve. The device attaches to a bracket that is secured at the other end to the upper toilet bowl flange by one of the toilet seat mounting screws and nuts, positioning the device under the water closet tank and protruding slightly forward. The water is supplied via a small plastic flexible tubing connected to a tubular "T" that is installed between the water closet overflow pipe and the orifice nozzle that is part of the water closet filling ballcock valve. Water flows into the small capacity reservoir whenever the toilet is flushed. To minimize having cold water replacing the ambient-air warmed water in the reservoir, a float actuating lever closes the input orifice when the reservoir is full. A venting orifice allows the release of air being displaced by the inflowing water. This vent is also connected by a parallel flexible tubing that leads back to the toilet water closet tank.

3 Claims, 7 Drawing Sheets

TOILET TISSUE WETTING DEVICE

BACKGROUND OF THE INVENTION

1. Field of the Invention

This invention relates to a personal hygiene apparatus and more particularly to an assembly that may be attached to or made a part of a conventional bathroom water closet for cleansing the posterior or anal and genital or vaginal areas of users of the water closet.

2. Description of the Prior Art

Bidets have for many years been in use throughout the world, but primarily in Europe, for cleansing and irrigating a person's anal and/or genital areas by flushing them with a spray of water. Bidets are typically unitary structures having a single purpose and are normally provided in bathrooms along with conventional toilets.

The principal reason for bidets not becoming more commonplace in homes is the expense associated with the installation of a separate bidet in a bathroom. The bidet is generally very expensive and often there is inadequate space in a bathroom for installation of a separate bidet.

The prior art includes a limited number of devices for attachment to a conventional toilet bowl or toilet seat for cleaning and irrigating the anal and/or genital areas of a user. Examples of such prior art bidet attachments are shown and described in U.S. Pat. No. 5,142,711 to Parikh, U.S. Pat. No. 5,101,520 to Lockhart, U.S. Pat. No. 5,090,067 to Cogdill, U.S. Pat. No. 3,045,248 to Gentry, and U.S. Pat. No. 3,195,148 to Merkel, Jr.; each of which discloses an attachment or assembly for mounting either on the upper surface of a toilet bowl or the under surface of a toilet seat for cleansing and irrigating the anal and/or genital areas.

Most of the prior art devices have been extremely complex, unsightly, difficult to install and have failed to meet appropriate sanitary standards, thus they have not been readily accepted. Furthermore, since most of the prior art devices take the water directly from the pressure refill pipe which usually dispense cold water. To provide warm or heated water, U.S. Pat. No. 5,090,067 to Cogdill provides a separate tank with an immersion heater located therein.

SUMMARY OF THE INVENTION

The instant invention is not a bidet. It is a system for moistening/wetting toilet tissue by means of a small reservoir fitted with air vents, a valve lever, an inlet and outlet orifice, and a water flow controlling valve. It attaches to a bracket, that is secured at the other end, to the upper toilet bowl flange, by one of the toilet seat mounting screws and nut, with the device positioned under the water closet and protruding slightly foreword. The water is supplied via a small plastic flexible tubing connected to a tubular "T" that is installed between the water closet over-flow pipe and the orifice nozzle, that is part of the water closet tank filling ballcock valve. There are many different versions of a ballcock valve, but one thing common to all designs is the orifice nozzle that allows extra water to flow into the toilet bowl to maintain the proper water level in the bowl.

The invention is easily installed on an ordinary household toilet. It will conveniently make a small amount of room temperature water available to the toilet user as a means of moistening/wetting toilet tissue as a final application to help more thoroughly cleanse the private parts of an individual's anatomy prior to flushing the toilet. Its location, away from the toilet bowl, protects it from any accidental splashing and thus keeps the device more sanitary and easier to clean.

It is therefore an object of the present invention to provide a toilet tissue wetting device which can be easily installed on the toilet bowl upper flange of a conventional toilet.

It is another object of the present invention to provide a toilet tissue wetting device which is simple and inexpensive to manufacture.

It is still another object of the present invention to provide an easily installed device which makes a small amount of room temperature water available for wetting the toilet tissue.

These objects as well as other aspects, objects and advantages of the present invention will become apparent to those skilled in the art after reading the following description of the preferred embodiments in conjunction with the accompanying drawings, and the appended claims.

DESCRIPTION OF THE PREFERRED EMBODIMENT

Figure 1:
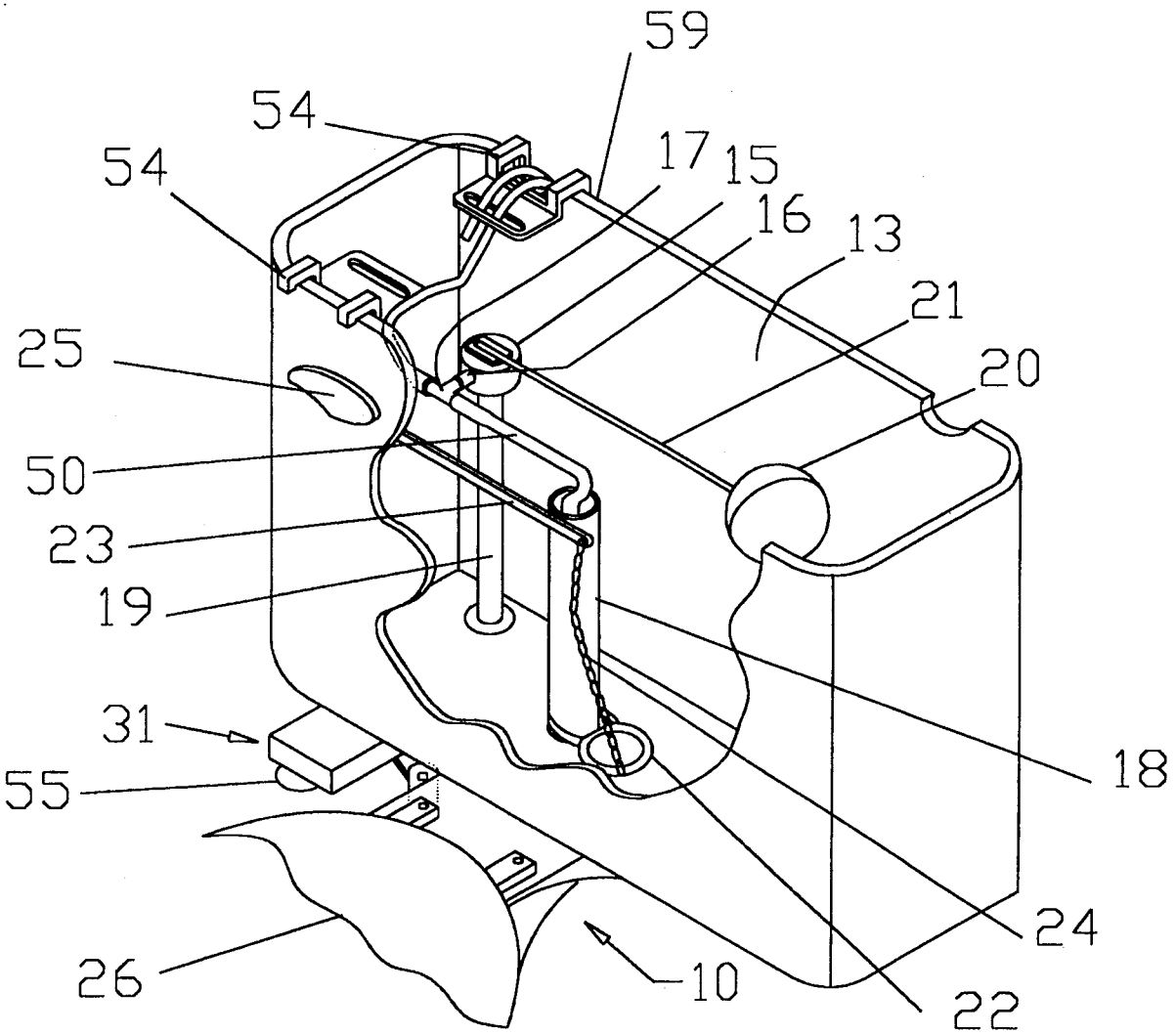
FIG. 1 is a reduced perspective view, partially in section, of a toilet tissue wetting device of the invention mounted on a toilet bowl upper flange.
Figure 2:
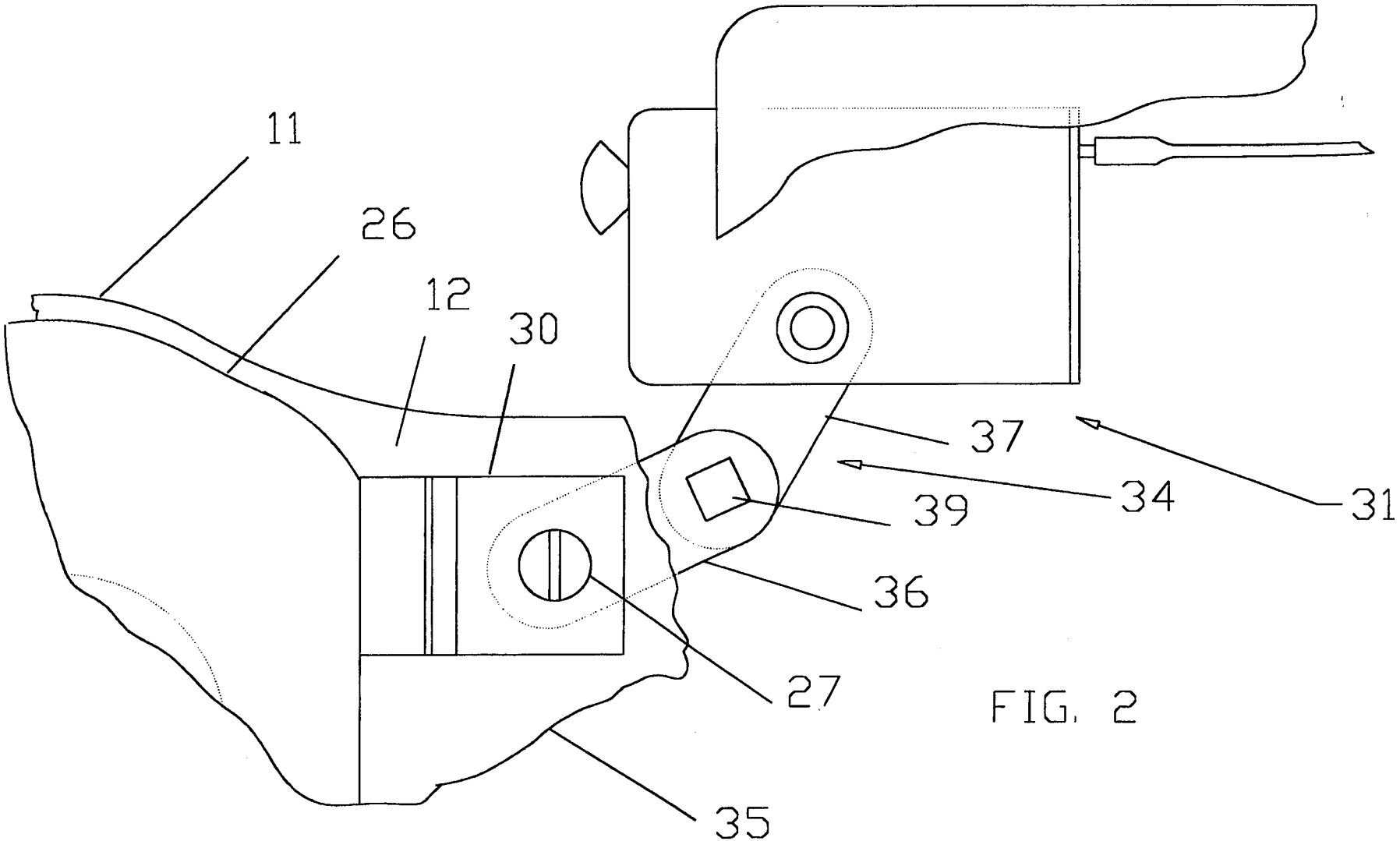
FIG. 2 is a top view, partially in section, of a toilet tissue wetting device of the invention.

Referring now to the drawings, numeral 10 generally designates a typical water closet toilet which is installed in most bathrooms. Typical water closet 10 comprises a toilet bowl 11 having a generally flat, oval, upper surface 12, a water reservoir tank 13, a tank cover (not shown), a ballcock valve 15, in communication with an outside water line 19 and having a conventional orifice/outlet 16, and a tank filling orifice (not shown), a tubular "T" 17, overflow pipe 18, a float 20 connected to ballcock 15 through float rod 21, a flapper ball valve 22, a trip lever 23, a chain 24, and a handle 25, an oval lid 26, an oval seat 14, seat and lid 26 fastening screws 27, seat fastening nuts 28, washers 29, and hinges 30.

Figure 3:
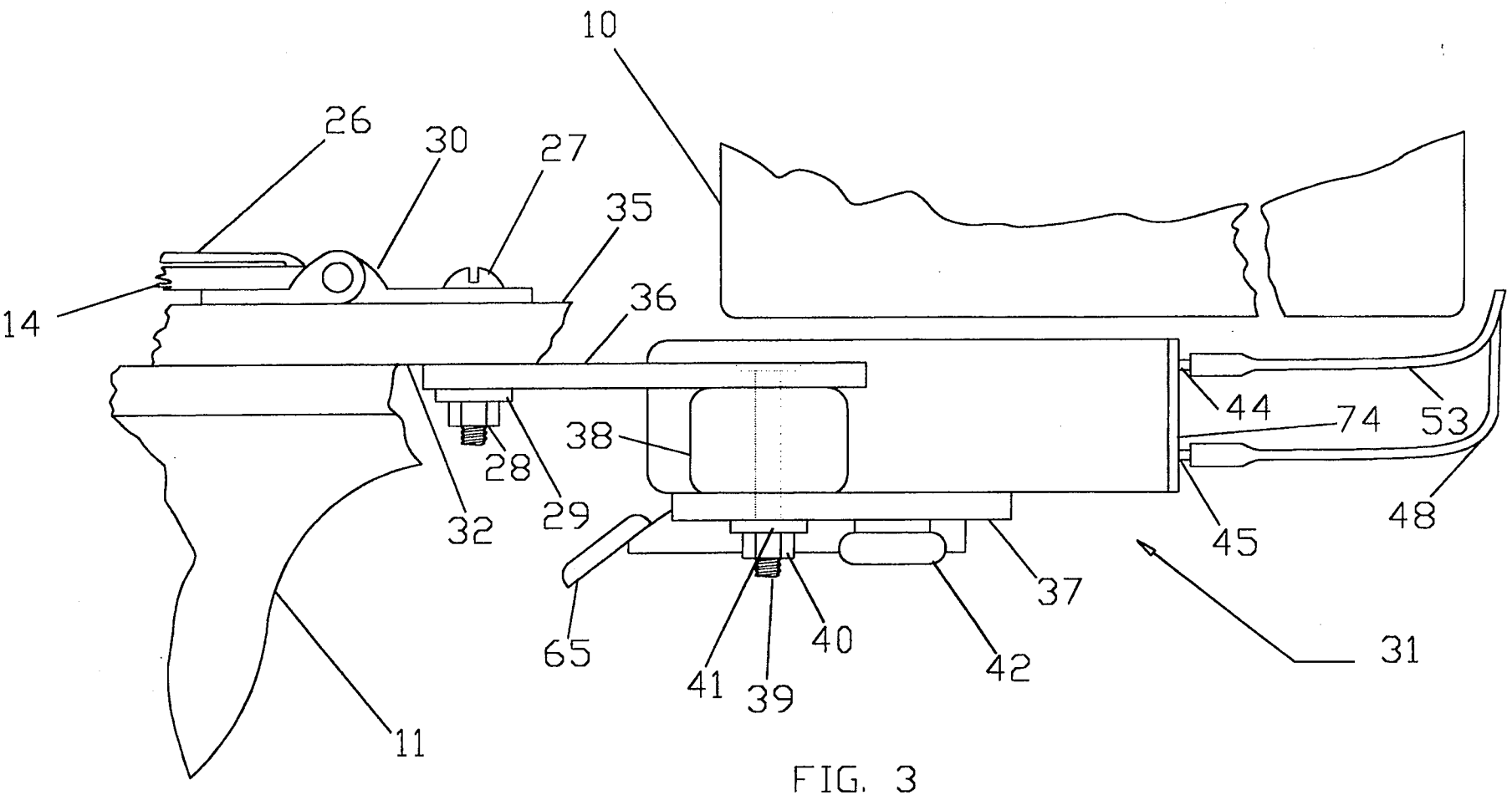
FIG. 3 is a side view, partially in section, of a toilet tissue wetting device of the invention, mounted on a toilet bowl flange.

FIG. 1 illustrates a toilet tissue wetting device assembly, generally designated by the reference numeral 31, as it is mounted below water closet 10 tank reservoir 13 and fastened to lower surface 32 of toilet bowl flange 35 (see FIG. 3). The wetting device assembly 31 comprises a small, about four ounce capacity, reservoir 33, (see FIG. 4.) and mounting bracket assembly 34, fastened to lower surface 32, of toilet bowl flange 35, (FIG. 3.) with seat fastening screw 27, washer 29 and nut 28. Mounting bracket assembly 34 comprises a first bracket arm 36, and a second bracket arm 37, fastened together and separated by spacer 38, washer 41, screw 39 and nut 40. Bolt 42 is used to fasten bracket arm 37 to device reservoir 33, with mounting screw assembly 43.

Figure 4:
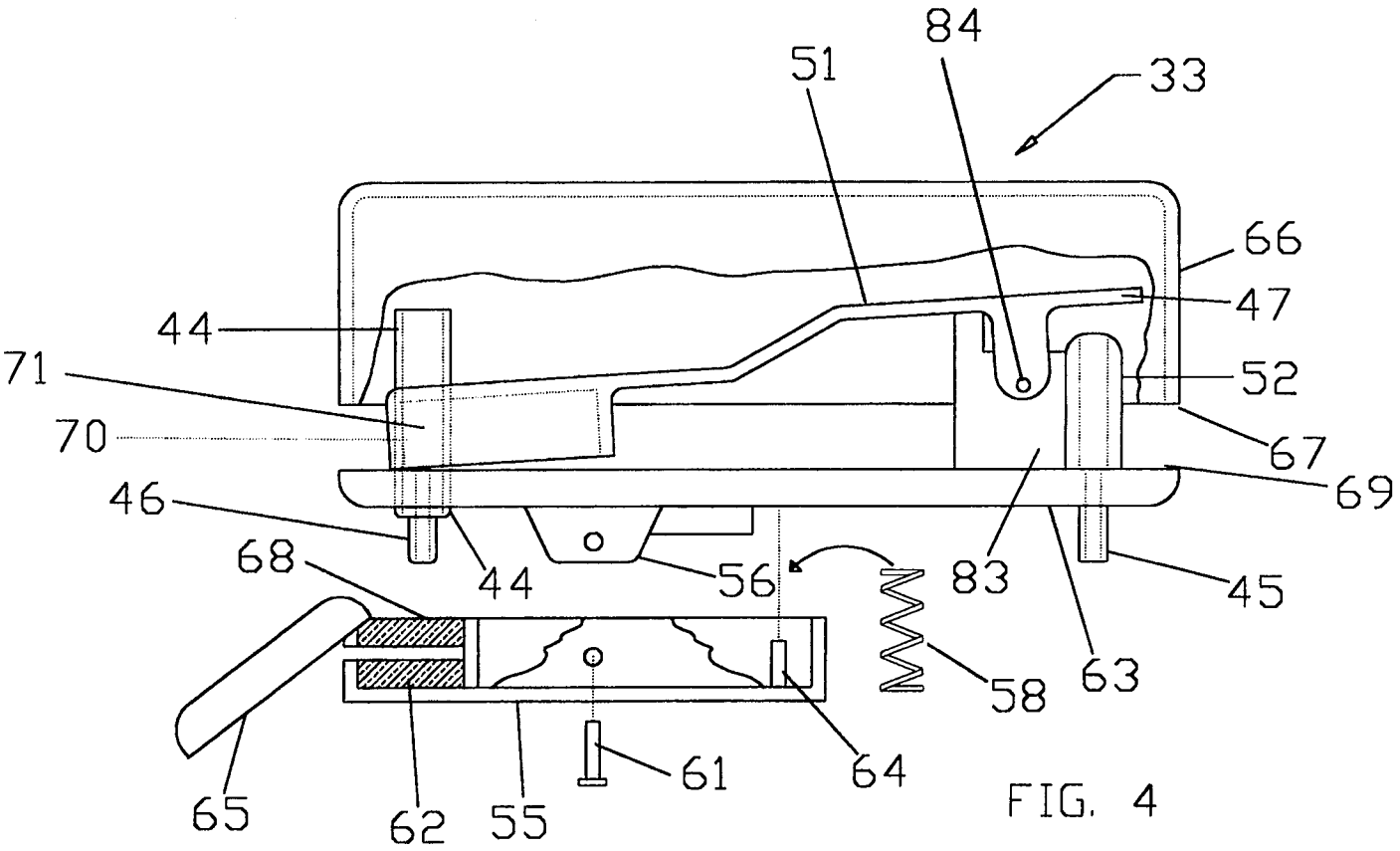
FIG. 4 is an exploded view, partially in section, of a side view of a toilet tissue wetting device using a water shut off lever.
Figure 5:
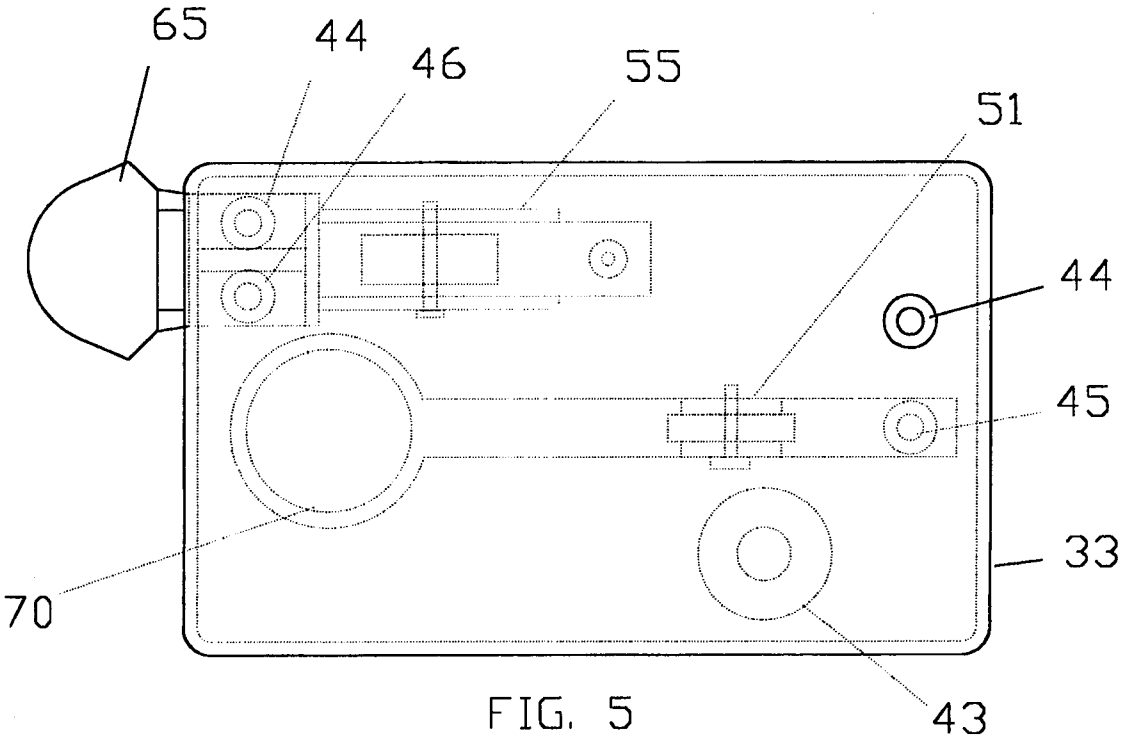
FIG. 5 is a top view of a toilet tissue wetting device using a water shut off lever.
Figure 7:
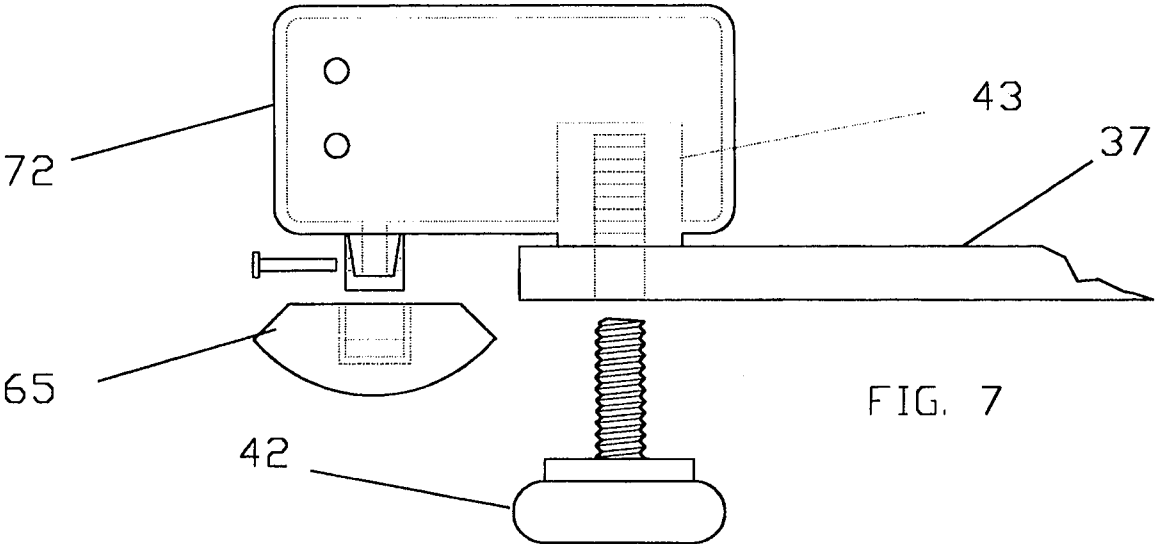
FIG. 7 is an exploded front view of a toilet tissue wetting device of the invention.
Figure 6:
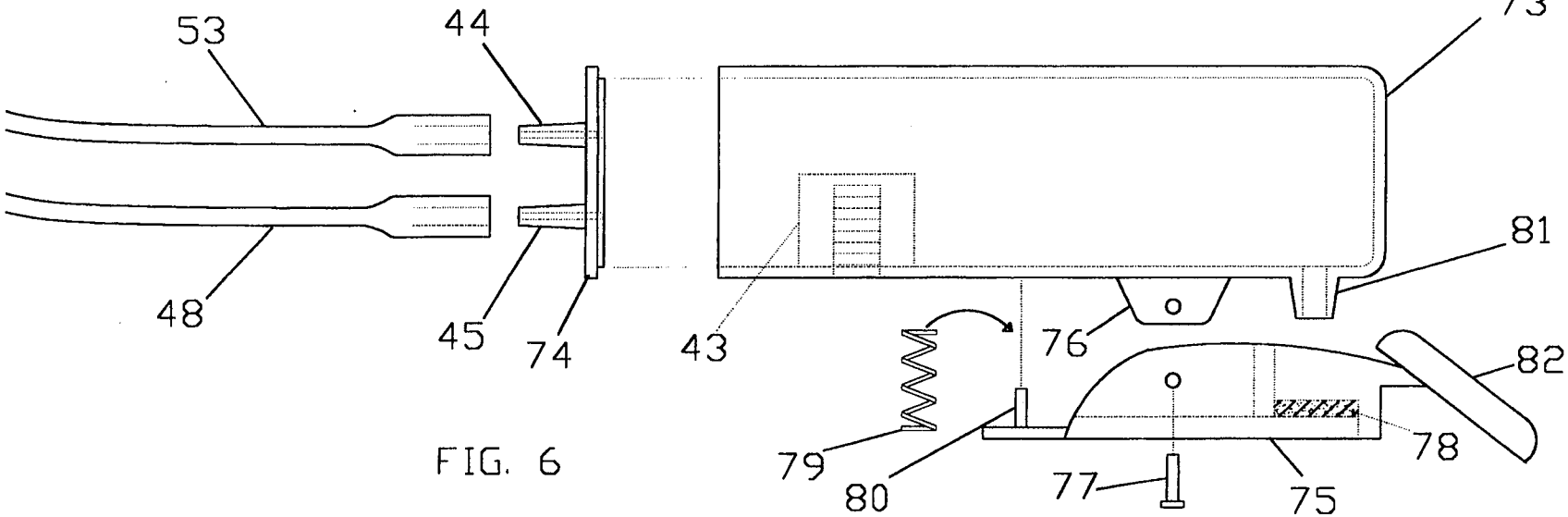
FIG. 6 is an exploded view of a side view of a toilet tissue wetting device not using a water shut off lever.
Figure 8:
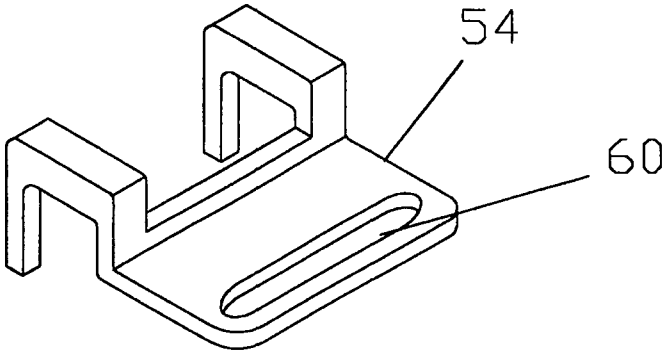
FIG. 8 is a perspective view of the water closet tank cover spacer.

FIG. 4 illustrates a reservoir 33 fitted with two air vents 44, inlet 45, water dispensing nozzle 46, and a water flow control valve 47. The water is supplied via a small plastic, flexible tubing 48 (FIG. 6.) connected to a tubular "T" 17 that is installed on the orifice nozzle 16 that is part of the water closet 10 tank filling ballcock valve 15. Bowl filling tubing 50 is connected to the other end of the "T" 17 and inserted into closet tank overflow pipe 18.

When the toilet is flushed, a small amount of water flows into the tank reservoir 33. To minimize having cold water replacing the ambient-air warmed water in the reservoir 33, a float 70, containing an air chamber 71 and attached to actuating lever 51 is pivotally mounted on pivot mount 83 with pin 84, and valve 47, closes the input orifice 52 when the reservoir 33 is full. A reservoir venting rear orifice 44 allows the release of air being displaced by the inflowing water. The rear venting orifice 44 is also connected by parallel flexible tubing 53 (FIG. 9) that leads back to the water closet reservoir 13 by bending the tubing 53 over the back side 59 of the water closet tank 13 and fastened by one of four toilet closet cover tank cover clips 54, directing the end of the tubing downward, but clear of the high water level of a full water closet 13. This venting tubing 53 also serves as an overflow means for excess water coming from the reservoir 13 filling ballcock valve 15 if and when the inlet control valve 47 is overpowered by greater pressure than normally present.

Figure 9:
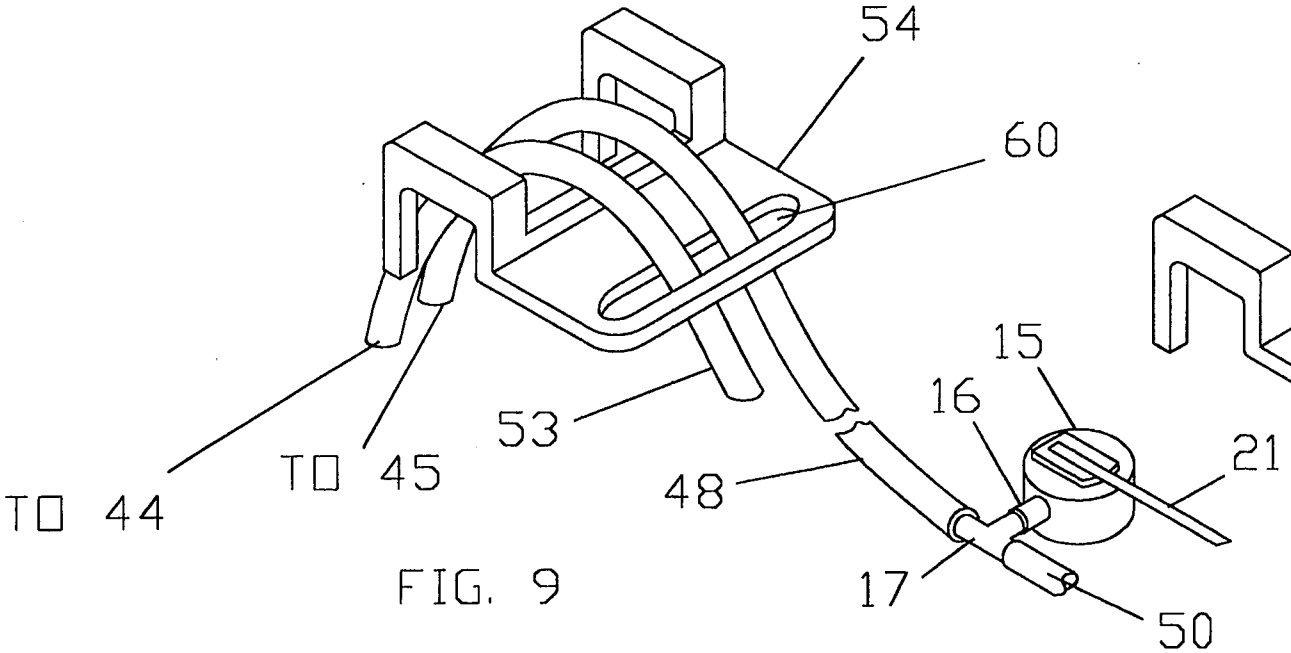
FIG. 9 is a perspective view of the water closet tank cover clip/spacer showing the cover spacer with the device reservoir filling tubing and air vent tubing.

The toilet tank cover spacer clips 54 are used to keep the cover from crushing the flexible soft plastic tubing as it is looped over the water closet tank 13, rear wall 59. Cover spacer clips 54 are generally installed on opposite sides, and at both ends of the water closet. On certain installations the spacer clips 54 will not be necessary. Securing the tubing 48 and 53, by means of inserting it through the oblong hole 60 in the spacer clips 54 keeps the tubing 48 and 53 from slipping out of position as shown in FIG. 1 and FIG. 9.

As shown in FIG. 4., water dispensing lever 55 is pivotally connected to pivot mount 56 formed on the bottom 63 of reservoir 33 with pin 61. Lower rubber pad 62 is fastened to water dispensing lever 55 to provide a water seal when the lever 55 is in the closed position and upper rubber pad 68 closes the air vent 44. Pad 68 is at a level above pad 62 to prevent water from adhering to the air vent 44. The surface tension of water across air vent 44 would block the entry of air into the reservoir 33 and thus prevent the flow of water from water dispensing nozzle 46 because of the very low pressure involved. Spring 58, mounted on protrusion 64, keeps the lever 55 in a position to seal water dispensing nozzle 46 and air vent 44 when in a rest position. Valve lever handle 65, fastened to lever 55, is used to depress water dispensing lever 55 to release a small amount of water to wet a tissue.

Typically, a user of the invention, while still seated, would use it as a final step of hygiene. Three or four sheets of tissue are laid across the fingers and placed under the reservoir 33 water dispensing lever 55 handle 65, while at the same time using the thumb to gently press downwardly on the spring biased handle 65, opening the air vent 44 and water dispensing orifice nozzle 46. The water is directly deposited and absorbed by the tissue and selectively saturated to any desired degree of wetness. Release of the handle immediately closes the air vent 44 and nozzle 46.

Reservoir 33, as shown in FIG. 4 is comprised of two basic parts, the upper container 66 and the bottom 63. The two parts, container 66 and bottom 63, are cemented together all around the outer surfaces of top surface 67 and bottom surface 69, to form a water-tight container, reservoir 33. In a second embodiment, reservoir 72, shown in FIG. 6, does not contain the float 70 nor the float actuating lever 51 and is designed for use where warmer climates prevail and incoming water is already warm enough. The reservoir 72 is constructed of two parts, the container 73 and the nozzle side 74, cemented together in the same manner as the assembly of reservoir 33, that is, by cementing the two sections together. Water dispensing lever 75, is pivotally connected to pivot mount 76 with pin 77. Rubber pad 78 is fastened to water dispensing lever 75 to provide a water seal when the lever 75 is in the closed position. Spring 79, mounted on protrusion 80, keeps the lever 75 in a position to seal water dispensing nozzle 81 when in a rest position. Valve lever handle 82, fastened to lever 75, is used to depress water dispensing lever 75 to release a small amount of water to wet a tissue as described above.

It is important to note that the invention is subjected to very low pressure when filling, and zero pressure when at rest, with gravity release of the reservoir 33 and 72 contained water. Only fresh, incoming water is used, completely free of closet 10 contained water.

Precut and packaged wet wiping products are marketed, but, often fail to be handy or wet enough, too wet, too large, too small etc. The product must be purchased and stored somewhere in the bathroom. It is never as convenient as the instant invention makes it. Once the invention is installed, it is always ready to wet or moisten an adequate amount of tissue, right at the user's fingertips. The invention is easy to install, simple to use, automatically fills, and requires no maintenance. Construction of the invention of a durable plastic material will make this product long lived and dependable.

While the above description constitutes preferred embodiments of the present invention, it will be appreciated that the invention is susceptible to modifications, variation and change without departing from the proper scope and fair meaning of the accompanying claims.

What is claimed is:

1. A toilet tissue wetting device adapted for use with a conventional water closet/toilet having a water reservoir tank including a ballcock valve having a water inlet and water outlet means in communication with an external water source, a hollow overflow tube having an upper opening, reservoir tank outlet means, a toilet bowl having a flat uppermost flange with an upper and a lower surface, a toilet seat fastened to the upper surface of the uppermost flange with a pair of bolts, washers and nuts, means for releasing water from said water reservoir tank through said reservoir tank outlet means to said toilet bowl, and means for actuating said ballcock for admitting water from said external water outlet means into said water reservoir tank, said tissue wetting device comprising:

a bracket having a first end and a second end, said bracket fastened at said first end to said lower surface of said flat uppermost flange with a bolt, washer and nut, said second end extending outwardly from said flange and under said water closet reservoir tank, reservoir means, for holding a small quantity of water, fastened to said second end of said bracket, said reservoir means having a back end located beneath said water closet reservoir tank and a front end protruding beyond said water closet reservoir tank, said reservoir means having a water inlet, an air vent, a water dispensing nozzle and a bottom, said bottom having a pivot mount formed thereon, a plurality of toilet closet tank cover spacer clips attached to said water closet walls, said spacer clips for retaining said cover in a slightly raised position, and each of said clips having an oblong hole therein, a tubular "T" fitting attached to said ballcock valve water outlet means, said fitting having flexible tubing attached thereto, and said tubing running up and over the top of said water closet tank wall through said oblong hole in one of said spacer clips and being connected to said reservoir means water inlet, for replenishing said quantity of water, flexible tubing attached to said reservoir means air vent, said tubing running parallel to said water outlet tubing, up and over the top of said water closet rear wall through said oblong hole in one of said spacer clips and ending above the water line in said closet tank, and water dispensing means, for dispensing selected quantities of water for wetting said toilet tissue, pivotally connected to said pivot mount, said dispensing means having a valve lever handle, a sealing pad for closing said water dispensing nozzle, and having spring biasing means mounted thereon for holding said sealing pad against said water dispensing nozzle and thus sealing said water dispensing nozzle when not being used.

2. The toilet tissue wetting device of claim I wherein said reservoir bottom has a second pivot mount and a water inlet nozzle formed thereon, and valve means, for controlling the water level in said reservoir, pivotally connected to said pivot mount.

3. The toilet tissue wetting device of claim 2 wherein said valve means consists of an actuating lever having a first portion and a second portion, said first portion having an air chamber float formed thereon and said second portion having a control valve formed thereon for engaging and sealing said water inlet nozzle when said float reaches a selected level.

* * * * *